United States Patent [19]

Neward

[11] Patent Number: 4,806,084

[45] Date of Patent: Feb. 21, 1989

[54] HAND-HELD VACUUM PUMP

[76] Inventor: Theodore C. Neward, 521 Scripps Dr., Claremont, Calif. 91711

[21] Appl. No.: 903,959

[22] Filed: Sep. 5, 1986

Related U.S. Application Data

[63] Continuation-in-part of Ser. No. 684,338, Dec. 20, 1984, abandoned.

[51] Int. Cl.[4] ..... F04B 41/00; F04B 39/10

[52] U.S. Cl. ..... 417/440; 417/566; 417/569; 92/194

[58] Field of Search ..... 417/306, 435, 437, 569, 417/566, 571, 440–442, 33; 92/194

[56] References Cited

U.S. PATENT DOCUMENTS

| | | | |
|---|---|---|---|
| 892,254 | 6/1908 | Hanson | 417/306 X |
| 2,138,605 | 11/1938 | Landis | 417/566 |
| 2,274,304 | 2/1942 | Perry | 92/194 |
| 2,277,256 | 3/1942 | Pfauser | 417/440 X |
| 2,297,655 | 9/1942 | Koch | 92/194 X |
| 2,491,633 | 12/1949 | Yuza | 417/566 X |
| 2,895,424 | 7/1959 | Tramontini et al. | 417/566 |
| 2,941,854 | 6/1960 | Jernander | 92/194 X |
| 2,973,231 | 2/1961 | Reynolds | 92/194 X |
| 3,612,722 | 10/1971 | Neward | 417/566 X |
| 3,664,774 | 5/1972 | Tupper et al. | 417/571 X |
| 3,730,217 | 5/1973 | Gute | 417/566 X |
| 3,900,276 | 8/1975 | Dilworth | 417/566 X |
| 3,957,399 | 5/1976 | Siczek | 417/388 X |
| 3,961,869 | 6/1976 | Droege, Sr. et al. | 417/566 X |
| 3,981,636 | 9/1976 | Aoki et al. | 417/566 |
| 4,038,983 | 8/1977 | Mittleman et al. | 417/566 X |
| 4,231,724 | 11/1980 | Hope et al. | 417/566 X |
| 4,259,042 | 3/1981 | Heatherly | 417/566 |
| 4,278,114 | 7/1981 | Ruberg | 417/566 X |
| 4,565,506 | 1/1986 | Williams | 417/566 X |

FOREIGN PATENT DOCUMENTS

| | | | |
|---|---|---|---|
| 1375871 | 9/1964 | France | 417/566 |
| 389075 | 6/1931 | United Kingdom | 417/566 |

OTHER PUBLICATIONS

Photograph of Neward Vacuum Pump.

*Primary Examiner*—Paul F. Neils
*Attorney, Agent, or Firm*—Lyon & Lyon

[57] ABSTRACT

A small and compact vacuum pump which serves as a postable vacuum source is disclosed. The pump includes a cylinder coupled with one handle and a piston therein coupled with another handle, along with a wafer valve assembly for allowing a vacuum to be drawn at an inlet of the pump. A previous version of the pump is improved upon by the use of different valve assemblies, to produce a more reliable, more easily assembled and less expensive vacuum pump. A vacuum release mechanism is provided operable with a finger of the hand about the handle.

12 Claims, 2 Drawing Sheets

HAND-HELD VACUUM PUMP

BACKGROUND OF THE INVENTION

Related Application

This application is a continuation-in-part of Ser. No. 684,338, filed Dec. 20, 1984, and now.abandoned.

The application is also associated with a co-pending application Ser. No. 904,697, filed Sept. 8, 1986. The contents of those applications are incorporated by reference herein.

The present invention relates to the filed of handheld vacuum pumps. It is a novel and useful improvement on the device disclosed in U.S. Pat. No. 3,612,722, issued to Theodore C. Neward.

Vacuum pumps are generally useful whenever a vacuum is desired, for example, to provide suction. Many types of vacuum pumps have been devised, but they often suffer from such drawbacks as complexity, expense, or excessive bulk. Accordingly, there is a need for a simple, inexpensive, lightweight, and compact handportable vacuum pump which can pull a useful vacuum, such as the vacuum pump of the present invention.

Hand-held and inexpensive vacuum pumps are especially useful in the automotive industry for vacuum system testing and repair, and for liquid sampling. They are also useful in some first aid applications, for testing for throat blockage of choking victims and for generating suction to eliminate any blockage.

U.S. Pat. No. 3,612,722 discloses a hand-held vacuum pump, and is incorporated herein by reference. The present invention is an improvement upon that device.

In particular, the present invention improves on the prior art in that it will produce a better vacuum which lends the new vacuum pump to a wider range of potential uses. The pump can also be used to provide a pressure of about two atmospheres for applications requiring air pressure. The present invention also improves on the prior art in that it is more resistant to dirt, contaminating fluids, and other foreign objects which may cause damage. This makes the new vacuum pump more reliable, a quality which is much desired in many environments.

Further, the present invention improves on the prior art in that it can be assembled and disassembled faster. This lends the new vacuum pump to easier and less costly manufacture and to quicker repair, which makes the new vacuum pump more available and more reliable. The present invention also improves on the prior art in that it uses less expensive parts. This reduces the cost of the new vacuum pump and makes it more available to quantity purchasers.

In prior art pumps where the vacuum is to be released, it is necessary to use a second hand to operate any release mechanism which may be provided. This is unduly cumbersome, especially when operating in a confined environment with limited maneuverability or when there are time restrictions.

It is an object of the present invention to provide an improved hand-held vacuum pump.

It is a second object of the present invention to produce a hand-held vacuum pump which produces a better vacuum.

It is a third object of the present invention to produce a hand-held vacuum pump which is more resistant to dirt and fluids.

It is a fourth object of the present invention to produce a hand-held vacuum pump which can be assembled and disassembled more quickly.

It is yet a fifth object of the present invention to produce a hand-held vacuum pump that is less expensive and that uses less expensive parts.

It is also an object to provide a pump operable with a single hand and wherein the vacuum can be released easily under finger control while held in the same hand that operates the vacuum release control.

These and other objects of the present invention will become clear after an examination of the drawings, the description, and the claims herein.

SUMMARY OF THE INVENTION

A pair of small handles suitable for gripping in one hand are arranged in a lever configuration, so that squeezing the handles causes a spring loaded piston to be drawn back in a sealed chamber. An umbrella valve is placed at one end of the sealed chamber and is recessed into the end of the chamber. Thus, when the piston is drawn back, a partial vacuum is created in the chamber and pressure is equalized by the creation of suction through the umbrella valve. When the handles are released, the spring causes the piston to be pushed forward to the end of the sealed chamber, releasing air through a second separate valve, namely a duckbill valve, also placed at the end of the chamber. Repeated squeezing and releasing of the two handles causes air to be steadily pumped in via the umbrella valve and out via the duckbill valve, thus generating a vacuum.

A vacuum release valve is located forwardly of the handles and the umbrella valve and is operable by extending the index finger of the hand about the handles to activate a movable arm to open and close the release valve.

DETAILED DESCRIPTION

Figure 1:
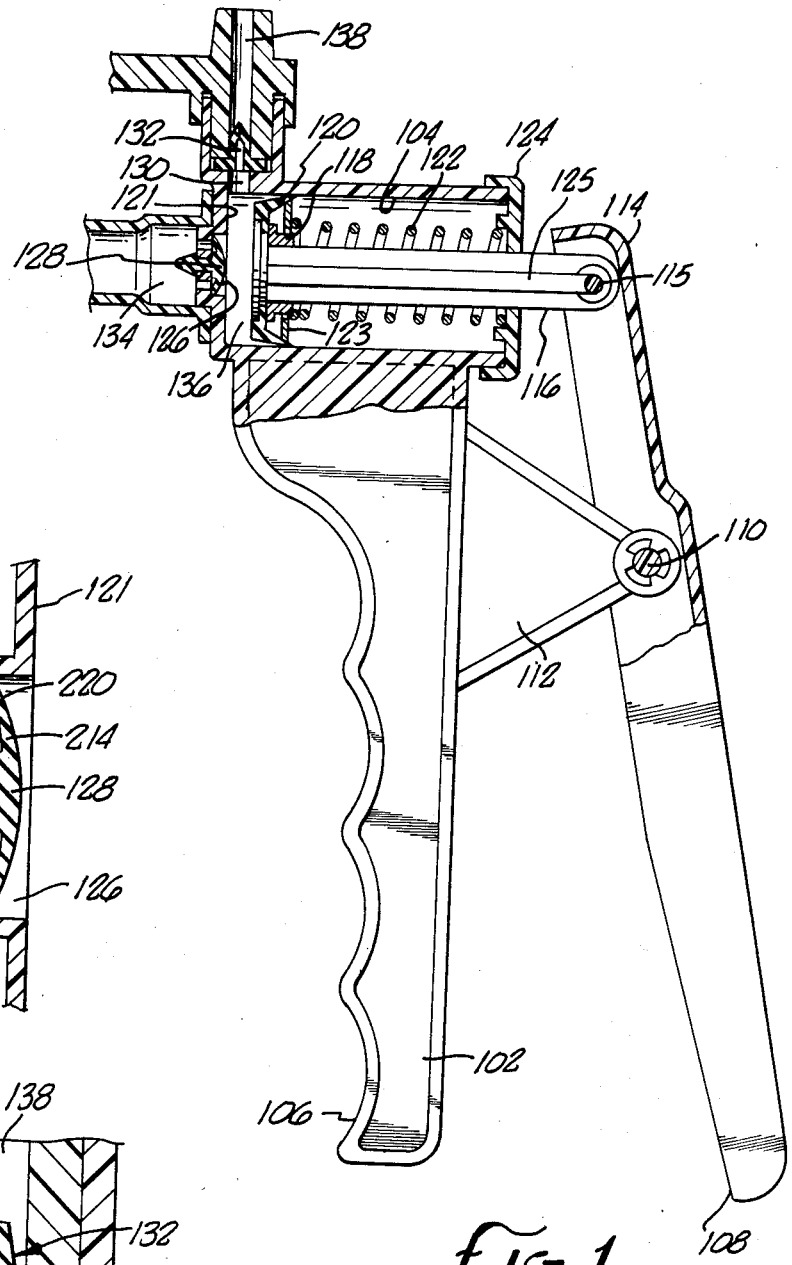
FIG. 1 is a cutaway view of one embodiment of the invention.

Referring now to FIG. 1, the operation of the present invention is disclosed.

The pump includes a fixed handle 102, which is attached to a sealed cylinder 104, and together they form the body of the pump. The fixed handle 102 is shaped to include indentations 106 for the fingers of an operator's hand. A movable handle 108 is pivoted at a joint 110 on a support 112 which is attached to the fixed handle 102. The end of the movable handle 114 is coupled via a joint 115 to a piston rod 116.

The piston rod 116 extends into the cylindrical chamber 104 and terminates in a cylindrical piston cap 118 with a resilient cylindrical piston 120 disposed thereon. The cap 118 and piston 120 are shown slightly drawn back from the inner end 121 of the cylindrical chamber 104. The piston 120 is pressed to the inner end of the cylinder 104 by a spring 122. One end of the spring 122 bears against a cap 124 secured to the outer end of the cylinder 104, and the other end of the spring 122 bears against a spreader ring 123. The spring 122 thus presses against the back side of the spreader ring 123 which in turn presses against the back side of the piston 120 to thereby improve the seal between the piston 120 and the cylinder 104.

The piston rod 116 may be flat and may have a pair of reinforcing ribs on either side, although only one rib 125 is shown in FIG. 1. When the pair of handles 102 and 108 is squeezed, the piston 120 will be drawn back. When the pair of handles is released, the spring 122 will cause the piston 120 to return to the inner end 121 of the cylinder 104.

Figure 2:
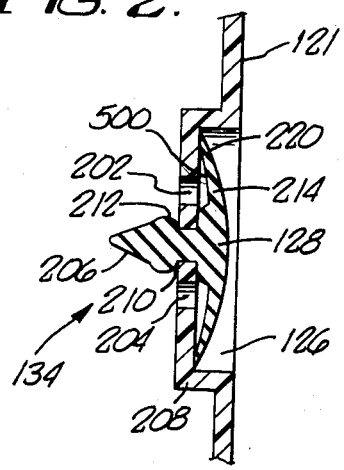
FIG. 2 is a cross-sectional view of an umbrella valve.

At the inner end of the cylindrical chamber 104 is a first recessed area 126 where an umbrella valve 128 is placed (see FIG. 2). Also at the inner end of the cylindrical chamber 104 is a second recessed area 130 at which a separate valve is placed, namely a duckbill valve 132 (see FIGS. 3 and 4). Note that the second recessed area 130 is normal to the axis of the cylindrical chamber. The cylindrical piston 120 can cover and seal this second recessed area 130 when the piston is at that end of the chamber.

When the piston is drawn back, air will be drawn from the pump's inlet area 134 into the area 136 evacuated by piston 120. When the handle is released and the spring loaded piston 120 returns to the inner end 121 of the cylindrical chamber 104 the air in the cylinder's evacuated area 136 will be forced to exit via the duckbill valve 132 to the pump's exhaust area 138. It can be easily seen that repeated squeezings and releasings of the two handles 102 and 108 will result in air being pumped from the inlet area 134 to the outlet area 138, and a high vacuum will be generated. In addition, pressure will be generated through the exhaust area 138, and such pressure may be utilized for appropriate applications.

Referring now to FIG. 2, the operation of an umbrella valve is disclosed.

The umbrella valve 128 operates in conjunction with a pair of air inlets 202 and 204. It comprises a rubber plug 206 (which may be made of polyfluorosilicone), which is inserted through retaining wall 208 at a plug-hole 210 and which is thickened at a section 212 to prevent it from falling through the plug-hole 210. Valve 128 also comprises a broad gas shield 214 which covers the air inlets 202 and 204 and which is impermeable to gases. The gas shield is flexible but has some tension, so that gas flow may occur from the inlet area 134 (FIG. 1), through the air inlets 202 and 204, past an edge 220 of the gas shield 214, to the other side of the gas shield shown as area 136. When the air pressure of inlet 134 exceeds that of area 136, gas flow will occur. However, when this air pressure differential is reversed, no gas flow will occur. By having inlets 202 and 204 on opposite sides of the central axis of the umbrella valve, and having a continuous chamber area 500 about the gas shield 214 the edge 220 is rendered uniformly operable about its perimeter thereby ensuring smooth gas flow with the valve and smooth operation of the pump.

An umbrella valve is a standard device and is well-known in the art.

Figure 3:
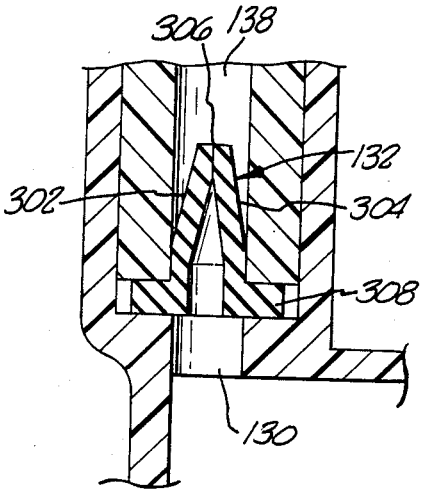
FIG. 3 is a cross-sectional view of a duckbill valve.
Figure 4:
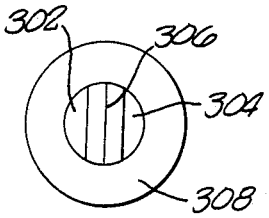
FIG. 4 is a top view of a duckbill valve.

Referring now to FIGS. 3 and 4, the operation of a duckbill valve is disclosed.

The duckbill valve 132 comprises a pair of solid, flexible walls 302 and 304 (which may be made of polyfluorosilicone) and which are compressed together at a lip 306. The valve 132 is anchored with a solid base 308 connected to the solid walls 302 and 304. The walls terminate in a lip 306 which is flexible but which has some tension, so that gas flow may occur from the inside area 130 to the outside areas 138 of the valve 132. When the air pressure of area 130 exceeds that of area 138, gas flow will occur from area 130 to area 138, but when the air pressure differential is reversed, no gas flow will occur.

A duckbill valve is a standard device and is well-known in the art.

Figure 5:
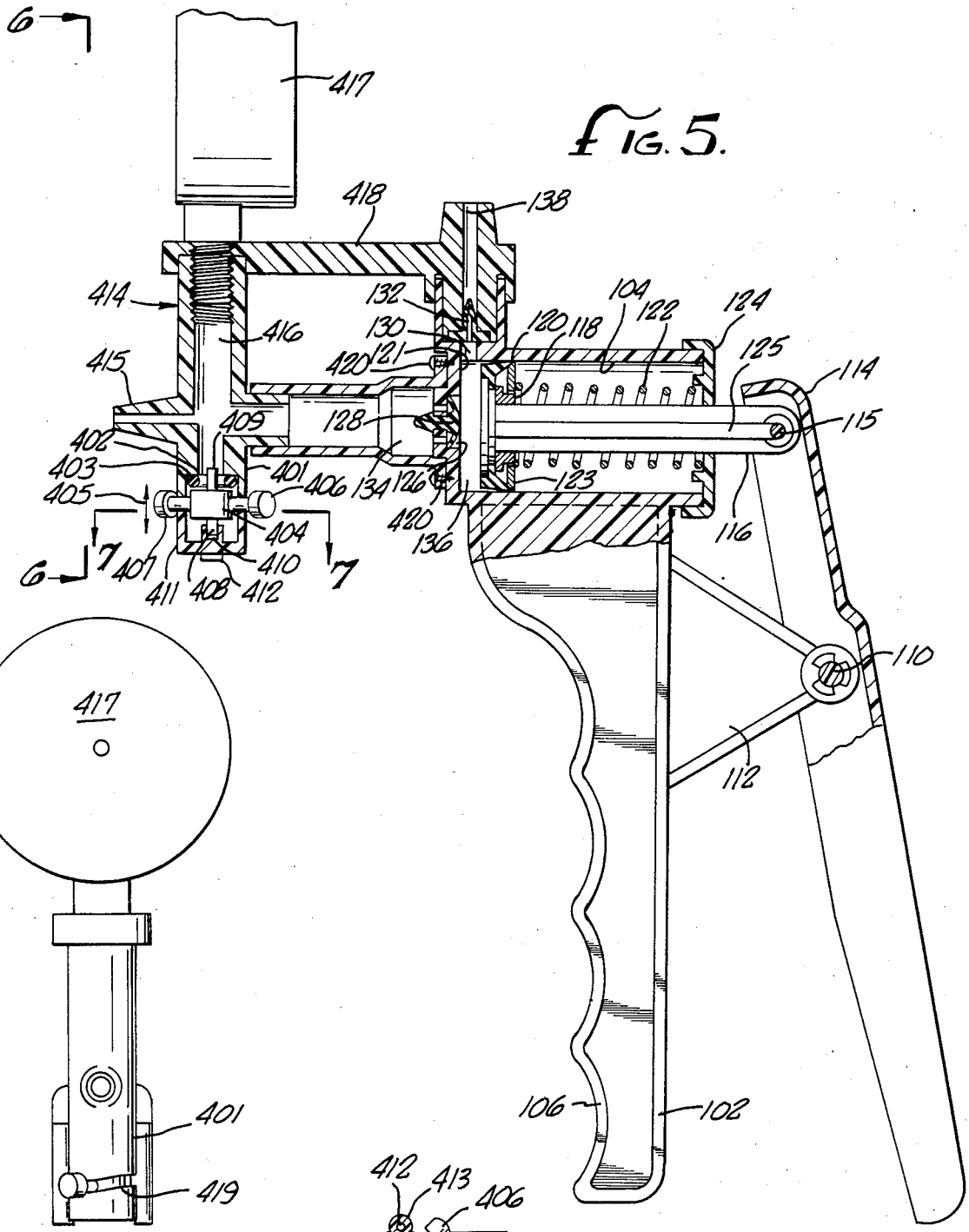
FIG. 5 is a cutaway view of a second embodiment of the invention.
Figure 6:
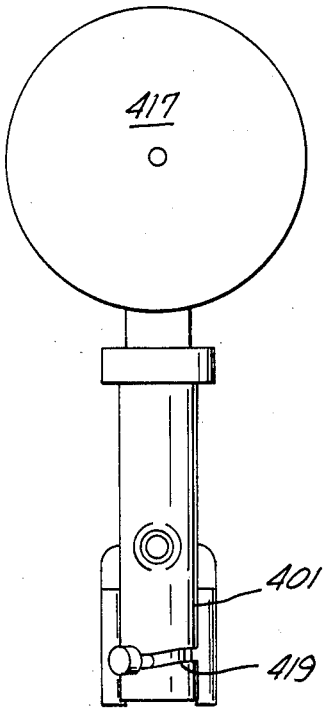
FIG. 6 is a partial side elevation of the vacuum release valve and vacuum gauge.
Figure 7:
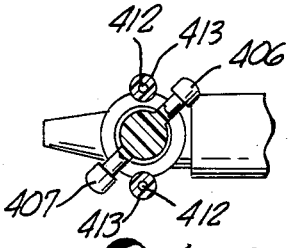
FIG. 7 is an underview, partially cutaway, of the vacuum release valve.

In FIGS. 5, 6 and 7 there is illustrated the vacuum release valve mechanism 400 which includes a casing 401 with a valve seat 402 about which there is located an 0-ring 403. A rotatable closure member 404 is movable upwardly and downwardly as indicated by arrow 405 to seat with the seat 402 or to be spaced from the seat, as indicated in FIG. 5.

The closure member 404 has two extending radial cams 406 and 407 which are operable by the index finger of the hand around the gripping handles of the pump. The closure member has a longitudinally directed axle 408 and 409. The axle 408 is housed in above 410 in a housing closure member 411 which is screw connected at 412 to the casing 401 (see FIG. 5 and 7). In this manner, the vacuum release valve can be easily assembled and disassembled. The screw connections 412 extend in pillars 413 located transversely of the pump longitudinal axis, the pillars 413 acting as barriers to limit the movement of the radial arms 406 and 407 to an arc transverse to the longitudinal axis. By this construction the arm 406 is maintained in a position which always faces the handles of the pump, and thereby control with the index finger is facilitated.

Operation of the arms 406 and 407 is such that they ride up or down a vertical slot 419 in the casing 401 thereby moving the closure member to or from the valve seat 402 (see FIG. 6). When on the seat the vacuum can be drawn by the pump, and when removed from the seat the vacuum is released.

The vacuum release valve is mounted ahead of the handles and the umbrella valve in a vacuum release body 414 which has a nozzle 415 at the leading end and a pipe 416 to permit connection of a vacuum gauge 417 (see FIG. 5). A support brace 418 connects the vacuum release body 414 to the vacuum pump duckbill valve housing.

The vacuum release body 414 is itself screw connected at 420 with the vacuum pump body. In this manner assembly and disassembly is also facilitated.

It should be understood that while a presently preferred embodiment has been disclosed, variations are possible which remain within the scope of the present invention.

What is claimed is:

1. A hand-held vacuum pump, comprising:

(a) cylinder means for isolating a certain volume from the atmosphere and equipped with an inlet opening and an outlet opening, (b) biased piston means, for drawing a vacuum through the inlet opening of the cylinder means when said biased piston means is drawn back, and for automatically returning said piston means to the end of said cylinder means when said piston means is no longer drawn back, (c) first valve means coupled with the inlet opening of the cylinder means, wherein said first valve means comprises an umbrella valve, and second valve means coupled with the outlet opening of the cylinder means, said second valve means being separate from the first valve means, (d) hand operated piston retractor means for drawing said piston means back within said cylinder means, whereby drawing said piston means back causes air to be drawn into said cylinder means via the inlet opening of the cylinder means, and whereby releasing said piston retractor means causes that air which was drawn in to be forced out via the outlet opening of said cylinder means, and (e) vacuum release valve means located in the inlet forwardly of the first valve means, including an arm associated with a valve closure means, said arm being operable by a finger of a hand about the piston retractor means, and substantially without removal of said hand from the piston retractor means, the arm in a first position corresponding to the vacuum release valve being open and in a second position corresponding the release valve being closed.

2. A hand-held vacuum pump, comprising:

(a) cylinder means for isolating a certain volume from the atmosphere and equipped with an inlet opening and an outlet opening, (b) biased piston means for drawing a vacuum through the inlet opening of the cylinder means when said piston means is drawn back, and for automatically returning said piston means to the end of the cylinder means when said piston means is no longer drawn back, (c) first valve means coupled with the inlet opening of the cylinder means, and second valve means coupled with the outlet opening of the cylinder means, wherein said second valve means comprises a duckbill valve, said second valve means being separate from the first valve means, (d) hand operated piston retractor means for drawing said piston means back within said cylinder means, whereby drawing said piston means back causes air to be drawn in via the inlet opening of the cylinder means, and whereby releasing said piston retractor means causes that air which was drawn in to be forced out via the outlet opening of the cylinder means, and (e) vacuum release valve means located in the inlet forwardly of the first valve means, including an arm associated with a valve closure means, said arm being operable by a finger of a hand about the piston retractor means, and substantially without removal of said hand from the piston retractor means, the arm in a first position corresponding to the vacuum release valve being open and in a second position corresponding the release valve being closed.

3. A hand-held vacuum pump, comprising:

(a) cylinder means for isolating a certain volume from the atmosphere, equipped with an inlet opening and an outlet opening, (b) biased piston means, for drawing a vacuum through the inlet opening of said cylinder means when said piston means is drawn back, and for automatically returning said piston means to the end of said cylinder means when said piston means is no longer drawn back, (c) first valve means coupled with the inlet opening of said cylinder means, wherein said first valve means comprises an umbrella valve, and second valve means coupled with the outlet opening of said cylinder means, wherein said second valve means comprises a duckbill valve, said second valve means being separate from the first valve means, (d) hand operated piston retractor means for drawing said piston means back within said cylinder means, whereby drawing said piston means back causes air to be drawn in via the inlet opening of the cylinder means, and whereby releasing said piston retractor means causes that air which was drawn into be forced out via the outlet opening of the cylinder means, and (e) vacuum release valve means located in the inlet forwardly of the first valve means, including an arm associated with a valve closure means, said arm being operable by a finger of a hand about the piston retractor means, and substantially without removal of said hand from the piton retractor means, the arm in a first position corresponding to the vacuum release valve being open and in a second position corresponding the release valve being closed.

4. A hand-held vacuum pump as claimed in claim 3 wherein the arm is rotable about an axis substantially transverse to the longitudinal axis of the pump between positions to either side of said longitudinal axis.

5. A hand-held vacuum pump as claimed in clam 4 including barrier means for limiting the movement of the arm between its open and closed position, and wherein the arm is located in a helical slot, whereby the valve closure means is movable towards and away from a valve seat.

6. A hand-held vacuum pump, comprising:

(a) cylinder means for isolating a certain volume from the atmosphere and equipped with an inlet opening and an outlet opening, (b) biased piston means for drawing a vacuum through the inlet opening of the cylinder means when said piston means is drawn back, and for automatically returning said piston means to the end of the cylinder means when said piston means is no longer drawn back, (c) first umbrella valve means coupled with the inlet opening of the cylinder means, and second valve means held between the outlet opening of the cylinder means and an exhaust means wherein said second valve means comprises a duckbill valve, (d) hand-operated piston retractor means for drawing said piston means back within said cylinder means, whereby drawing said piston means back causes air to be drawn in via the inlet opening of the cylinder means, and whereby releasing said piston retractor means causes that air which was drawn into be forced out via the outlet opening of the cylinder means, and (e) vacuum release valve means located in the inlet forwardly of the first valve means, including an arm associated with a valve closure means, said arm being operable by a finger of a hand about the piston retractor means, and substantially without removal of said hand from the piston retractor means, the arm in a first position corresponding to the vacuum release valve being open and in a second position corresponding the release valve being closed.

7. A hand-held vacuum pump, comprising:

(a) cylinder means for isolating a certain volume from the atmosphere and equipped with an inlet opening and an outlet opening, (b) biased piston means, for drawing a vacuum through the inlet opening of the cylinder means when said biased piston means is drawn back, and for automatically returning said piston means to the end of said cylinder means when said piston means is no longer drawn back, (c) first valve means coupled with the inlet opening of the cylinder means, wherein said first valve means comprises a recessed umbrella valve, and second valve means coupled with the outlet opening of the cylinder means, said second valve means being separate from the first valve means, (d) hand operated piston retractor means for drawing said piston means back within said cylinder means, whereby drawing said piston means back causes air to be drawn into said cylinder means via the inlet opening of the cylinder means, and whereby releasing said piston retractor means causes that air which was drawn in to be forced out via the outlet opening of said cylinder means, and (e) vacuum release valve means located in the inlet forwardly of the first valve means, including an arm associated with a valve closure means, said arm being operable by a finger of a hand about the piston retractor means, and substantially without removal of said hand from the piston retractor means, the arm in a first position corresponding to the vacuum release valve being open and in a second position corresponding the release valve being closed.

8. A hand-held vacuum pump, comprising:

(a) cylinder means for isolating a certain volume from the atmosphere and equipped with an inlet opening and an outlet opening, (b) biased piston means for drawing a vacuum through the inlet opening of the cylinder means when said piston means is drawn back, and for automatically returning said piston means to the end of the cylinder means when said piston means is no longer drawn back, (c) first valve means coupled with the inlet opening of the cylinder means, and second valve means coupled with the outlet opening of the cylinder means, wherein said second valve means comprises a recessed duckbill valve, said second valve means being separate from the first valve means, (d) hand operated piston retractor means for drawing said piston means back within said cylinder means, whereby drawing said piston means back causes air to be drawn in via the inlet opening of the cylinder means, and whereby releasing said piston retractor means causes that air which was drawn in to be forced out via the outlet opening of the cylinder means, and (e) vacuum release valve means located in the inlet forwardly of the first valve means, including an arm associated with a valve closure means, said arm being operable by a finger of a hand about the piston retractor means, and substantially without removal of said hand from the piston retractor means, the arm in a first position corresponding to the vacuum release valve being open and in a second position corresponding the release valve being closed.

9. A hand-held vacuum pump, comprising:

(a) cylinder means for isolating a certain volume from the atmosphere, equipped with an inlet opening and an outlet opening, (b) biased piston means, for drawing a vacuum through the inlet opening of said cylinder means when said piston means is drawn back, and for automatically returning said piston means to the end of said cylinder means when said piston means is no longer drawn back, (c) first valve means coupled with the inlet opening of said cylinder means, wherein said first valve means comprises a recessed umbrella valve, and second valve means coupled with the outlet opening of the cylinder means, wherein said second valve means comprises a recessed duckbill valve, said second valve means being separate from the first valve means, (d) hand operated piston retractor means for drawing said piston means back within said cylinder means, whereby drawing said piston means back causes air to be drawn in via the inlet opening of the cylinder means, and whereby releasing said piston retractor means causes that air which was drawn in to be forced out via the outlet opening of said cylinder means, and (e) vacuum release valve means located in the inlet forwardly of the first valve means, including an arm associated with a valve closure means, said arm being operable by a finger of a hand about the piston retractor means, and substantially without removal of said hand from the piston retractor means, the arm in a first position corresponding to the vacuum release valve being open and in a second position corresponding the release valve being closed.

10. A hand-held vacuum pump as claimed in claim 9, wherein the arm is rotable about an axis substantially transverse to the longitudinal axis of the pump between positions to either side of said longitudinal axis.

11. A hand-held vacuum pump as claimed in claim 10, including barrier means for limiting the movement of the arm between its open and closed positions, and wherein the arm is located in a helical slot, whereby the valve closure means is movable towards and away from a valve seat.

12. A hand-held vacuum pump, comprising:

(a) cylinder means for isolating a certain volume from the atmosphere and equipped with an inlet opening and an outlet opening, (b) biased piston means for drawing a vacuum through the inlet opening of the cylinder means when said piston means is drawn back, and for automatically returning said piston means to the end of the cylinder means when said piston means is no longer drawn back, (c) first recessed umbrella valve means coupled with the inlet opening of the cylinder means, and second valve means held between the outlet opening of the cylinder means and an exhaust means wherein said second valve means comprises a recessed duckbill valve, (d) hand operated piston retractor means for drawing said piston means back within said cylinder means, whereby drawing said piston means back causes air to be drawn in via the inlet opening of the cylinder means, and whereby releasing said piston retractor means causes that air which was drawn in to be forced out via the outlet opening of said cylinder means, and (e) vacuum release valve means located in the inlet forwardly of the first valve means, including an arm associated with a valve closure means, said arm being operable by a finger of a hand about the piston retractor means, and substantially without removal of said hand from the piston retractor means, the arm in a first position corresponding to the vacuum release valve being open and in a second position corresponding the release valve being closed.

* * * * *